United States Patent [19]

Schraub

[11] Patent Number: 4,628,997

[45] Date of Patent: Dec. 16, 1986

[54] PACKOFF

[75] Inventor: John D. Schraub, Walker County, Tex.

[73] Assignee: Hughes Tool Company, Houston, Tex.

[21] Appl. No.: 623,803

[22] Filed: Jun. 22, 1984

[51] Int. Cl.[4] ..... E21B 33/128; E21B 23/06

[52] U.S. Cl. ..... 166/196; 277/116.6; 277/117

[58] Field of Search ..... 166/134, 138, 196, 202, 166/387; 277/116.2, 116.4, 116.6, 117

[56] References Cited

U.S. PATENT DOCUMENTS

| | | | |
|---|---|---|---|
| 234,102 | 11/1880 | Williams | 277/116.4 |
| 2,217,986 | 10/1940 | Knox | 277/116.6 |
| 2,404,692 | 7/1946 | Church | 166/134 X |
| 2,418,493 | 4/1947 | Allen | 166/196 X |
| 2,433,942 | 1/1948 | Works | 166/196 X |
| 2,802,534 | 8/1957 | Conrad | 166/196 X |
| 3,054,452 | 9/1962 | Clark, Jr. et al. | 166/134 |
| 3,181,614 | 5/1965 | Brown | 166/134 X |
| 3,278,192 | 10/1966 | Tamplen | 166/196 X |
| 3,391,740 | 7/1968 | Edwards, Jr. | 166/134 X |
| 3,416,608 | 12/1968 | Crow et al. | 166/134 X |
| 3,422,899 | 1/1969 | Brown | 166/138 X |
| 3,666,010 | 5/1972 | Harris | 166/134 |
| 4,433,726 | 2/1984 | Preston, Jr. et al. | 166/134 X |
| 4,441,559 | 4/1984 | Evans et al. | 166/387 X |

*Primary Examiner*—James A. Leppink
*Assistant Examiner*—John F. Letchford
*Attorney, Agent, or Firm*—H. Dennis Kelly

[57] ABSTRACT

A packoff having a metal energizing ring, mounted around a packoff mandrel. A pair of elastomeric packing elements are also mounted around the packoff mandrel, one on each side of the energizing ring. When the packoff is set, the packing elements are forced toward the energizing ring, and tapered surfaces on the energizing ring force the packing elements into sealing engagement with a well conduit.

3 Claims, 4 Drawing Figures

PACKOFF

BACKGROUND OF THE INVENTION

1. Field of the Invention

This invention relates in general to devices for sealing the annulus between two cylindrical members, and in particular to packoffs for sealing off an isolated zone of well tubing.

2. Description of the Prior Art

Once a well has been drilled from the earth's surface to an oil bearing formation, oil either flows to the surface naturally or it does not. About nine out of every ten oil wells in the United States require artificial lift to get the oil to the surface. Various pumping systems have been applied to this task, including electrical and hydraulic downhole pumps. However, one of the most popular means of artificial lift is not a pumping system, but a system known as gas lift.

In the gas lift system, gas is injected into the fluid column downhole to cause oil to flow or to flow more abundantly. A series of gas lift valves are placed at calculated intervals in the tubing string. Gas is then pumped down into the well through the annulus between the tubing string and the well casing. When a gas lift valve is opened, gas enters the tubing string from the annulus. The gas, being much lighter than the oil, reduces the weight of the oil column, causing the oil to flow to the surface.

One means of mounting the gas lift valves in the tubing string is by the use of packoff installations. A packoff installation has a gas lift valve mounted between a pair of packoffs. Tubing or collar stops are set at specific locations and holes are perforated in the tubing string. The packoff installation is run down into the tubing string, contacting a stop so that the packoffs are on either side of the hole in the tubing string. When the packoffs are set the casing pressure cannot enter the tubing until the gas lift valve is opened. An example of this type of packoff installation is shown in FIG. 4 of U.S. Pat. No. 3,278,192 (Tamplen), issued Oct. 11, 1966. Packoffs often experience high differential pressures between the casing pressure in the annulus and the tubing pressure in the tubing string, either the casing pressure or the tubing pressure being greater.

SUMMARY OF THE INVENTION

The general object of the invention is to provide a packoff in which an increased differential pressure will result in a tighter seal.

The above object is accomplished by a packoff having a pair of packing elements, one on each side of an inelastic energizing ring. The energizing ring has upper and lower tapered surfaces, and each packing element has an axial extension which engages one of the tapered surfaces on the energizing ring. As the mandrel is forced into the body of the packoff, the packing elements are driven toward the energizing ring. The axial extensions are driven up the tapered surfaces, and radially outward toward the surrounding well conduit, which is the interior surface of the tubing string. The packing elements seal the annular space between the tubing string and the energizing ring or the mandrel. Any differential pressure which develops across the seal will act on the area of the energizing ring and force it into a packing element, wedging the packing element more tightly into the tubing string. Therefore, the greater the differential pressure, the tighter the seal.

The above, as well as additional objects, features, and advantages of the invention, will become apparent in the following detailed description.

DESCRIPTION OF THE PREFERRED EMBODIMENT

Figure 1A:
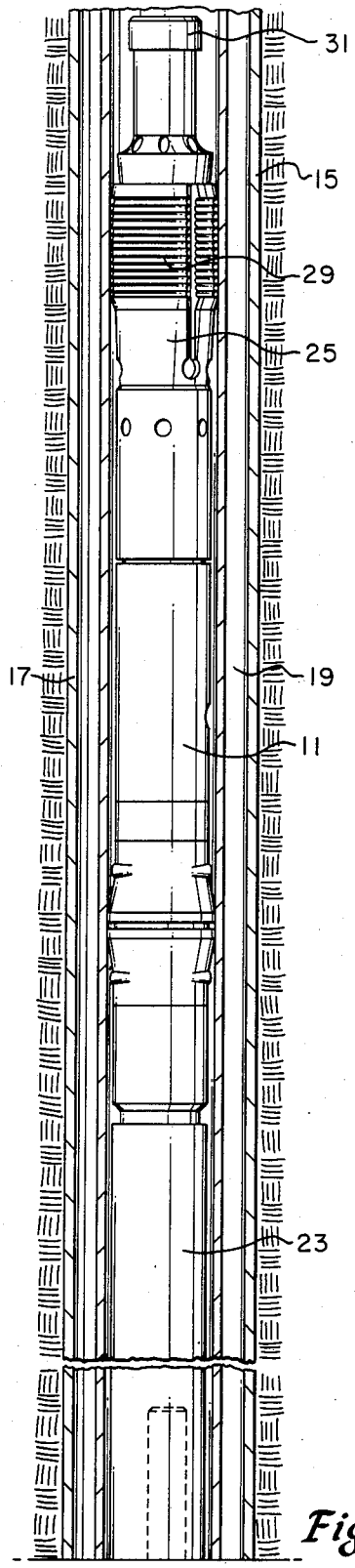
FIG. 1 is a side view of a packoff installation, installed in a tubing string.
Figure 1B:
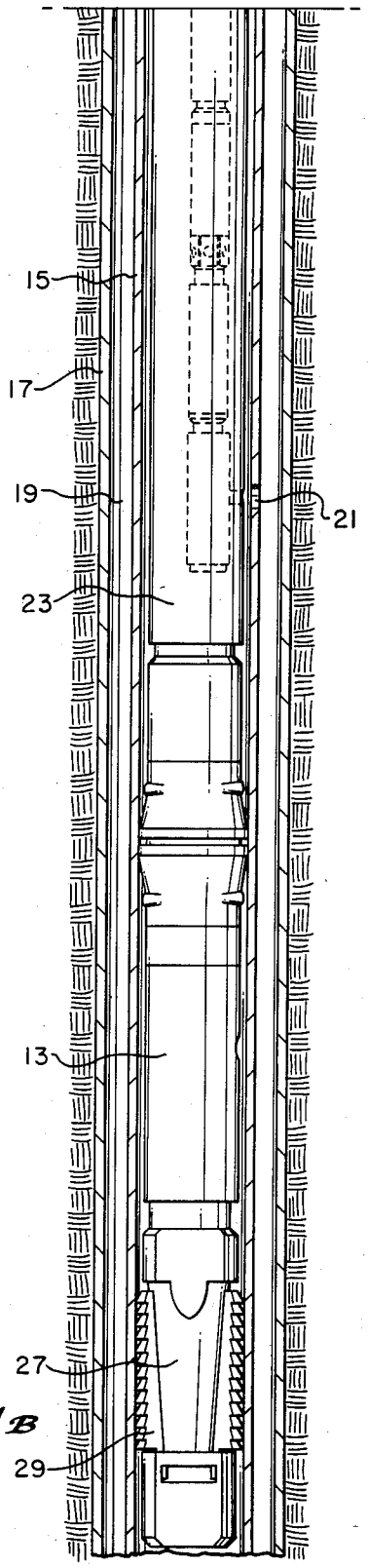

FIG. 1 illustrates the use of a pair of packoffs 11, 13 in a packoff installation for mounting a gas lift valve. The packoff installation is disposed within a tubing string 15 suspended within a well casing 17. The annulus 19 between the tubing string 15 and the well casing 17 contains fluid at a pressure known as the casing pressure. A perforation 21 is punched in the tubing string 15 to allow casing pressure to pass into the tubing string 15.

The gas lift valve is mounted within a special clearance mandrel 23, which is secured between the upper packoff 11 and the lower packoff 13. The packoff installation also has a hold down 25 at the top and a tubing stop 27 at the bottom. The hold down 25 and the tubing stop 27 have gripping elements 29 for gripping the interior surface of the tubing 15. The hold down 25 may have either an interior fishing head or an exterior fishing neck. The hold down 25 shown in FIG. 1 has an exterior fishing neck 31.

Figure 2:
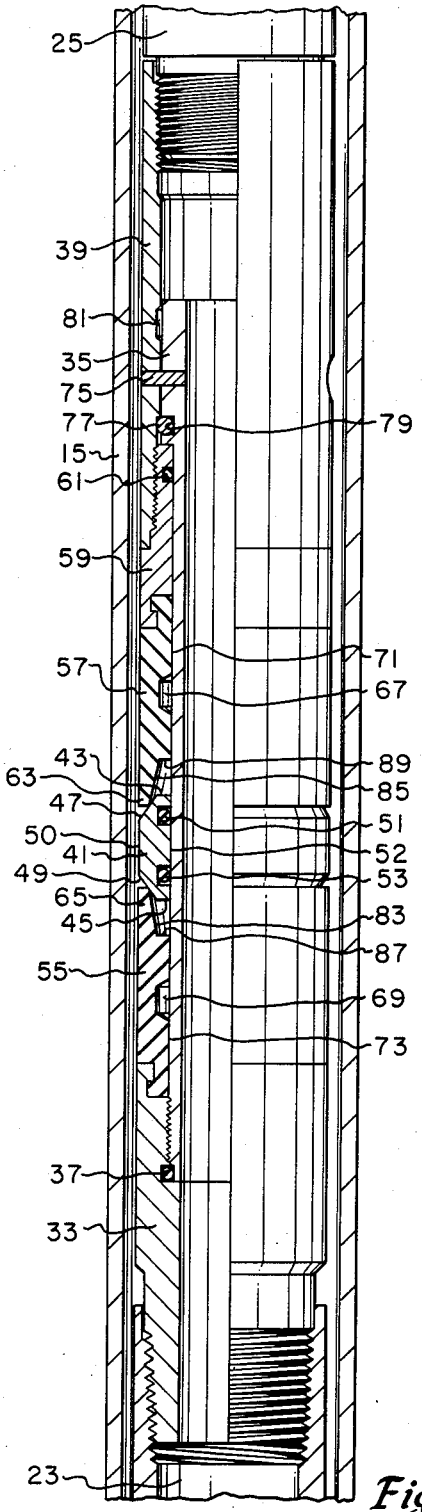
FIG. 2 is a side view, partially in section, of an upper packoff, in the unset condition.
Figure 3:
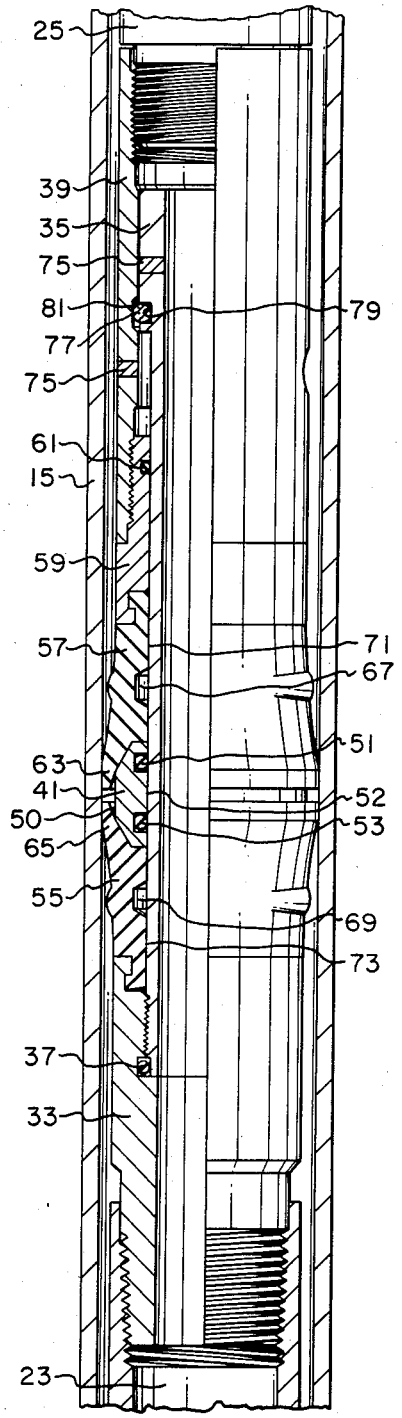
FIG. 3 is a side view, partially in section, of a packoff in the set condition.

FIGS. 2 and 3 show the upper packoff 11 in greater detail and partially in section. The upper packoff 11 has at the lower end an adapter 33, which is threaded to the upper end of the gas lift mandrel 23. A cylindrical packoff mandrel 35 is threaded to the adapter 33, and the connection is sealed by an O-ring 37. The adapter 33 is thus means for connecting one end of the packoff mandrel 35 to the gas lift mandrel 23. The other end of the packoff mandrel 35 is telescopically received within the cylindrical body 39 of the packoff 11. The body 39 of the packoff 11 is in turn threaded to the hold down 25.

The lower packoff 13 is identical to the upper packoff 11, but is oriented in the opposite direction. The adapter 33 of the lower packoff 13 is at the top of the packoff 13 and is threaded to the lower end of the gas lift mandrel 23. The lower end of the lower packoff 13 is plugged, and rests upon the tubing stop 27.

In each of the packoffs 11, 13 an inelastic metal energizing ring 41 is mounted around the packoff mandrel 35. The energizing ring 41 has upper and lower horizontal surfaces 43, 45 and upper and lower tapered surfaces 47, 49. The tapered surfaces 47, 49 taper inward from the outer circumference 50 of the energizing ring 41 to the upper and lower horizontal surfaces 43, 45. The outer circumference 50 of the energizing ring 41 is therefore wider, from top to bottom, than the inner circumference 52 of the energizing ring 41. A pair of O-ring seals 51, 53 seal between the energizing ring 41 and the packoff mandrel 35.

A pair of elastomeric packing elements 55, 57 are also mounted around the packoff mandrel 35, one on each side of the energizing ring 41. The lower packing element 55 is connected to the adapter 33, and the upper packing element 57 is connected to a packing element hold down 59, which is threadedly connected to the body 39 of the packoff 11. An O-ring 61 seals between the packing element hold down 59 and the packoff mandrel 35. The adapter 33 and the packing element hold down 59 are thus means for connecting one of the packing elements 57 to the body 39, and the other packing element 55 to the packoff mandrel 35.

Each packing element 55, 57 has an axial extension 63, 65. Each extension 63, 65 is radially outward from the packoff mandrel 35, and extends toward the energizing ring 41. In the unset condition, shown in FIG. 2, the extensions 63, 65 each rest on one of the tapered surfaces 47, 49 of the energizing ring 41. Each packing element 55, 57 also has an annular recess 67, 69 on the inner wall 71, 73 of the packing elements 55, 57.

A brass shear pin 75 holds the packoff mandrel 35 against axial movement in respect to the body 39 of the packoff 11 when the packoff is in the unset condition. Spring segments 77 are located in an annular groove 79 on the outside surface of the packoff mandrel 35. The body 39 of the packoff 11 has an annular groove 81 on its interior surface.

In operation the packoff installation is lowered into the tubing string 15 by a conventional wireline (not shown) or by some other conventional method. The packing installation is lowered until the upper and lower packoffs 11, 13 are on either side of the perforation 21 in the tubing 15. The packing installation is then jarred to set the gripping elements 29 on the hold down 25 and on the tubing stop 27. The packoffs 11, 13 are also set by jarring the packoff installation. When the installation is jarred, the shear pin 75 is fractured, and the body 39 of the upper packoff 11 is forced downward onto the packoff mandrel 35. The packing element hold down 59, which is connected to the body 39, is thus forced toward the adapter 33, which is connected to the packoff mandrel 35. The adapter 33 holds the lower packing element 55 stationary, and the packing element hold down 59 forces the upper packing ring 57, the energizing ring 41, and the lower packing element downward. As the packing elements 55, 57 and the energizing ring 41 move toward the adapter 33, the axial extensions 63, 65 are forced radially outward by the tapered surfaces 47, 49. The adapter 33 and the packing element hold down 59 are thus means for forcing the packing elements 55, 57 against the energizing ring 41, so that the tapered surfaces 47, 49 force the packing elements 55, 57 radially outward into sealing engagement with a circumscribing well conduit, such as the tubing string 15, when the body 39 is moved axially on the packoff mandrel 35 toward the adapter 33.

When the upper packoff 11 has reached the set condition, shown in FIG. 3, the packing elements 55, 57 have contacted the tubing 15 interior wall and have sealed the annular space between the mandrel 35 and the tubing string 15. Each packing element 55, 57 has a surface 83, 85 which engages one of the tapered surfaces 47, 49, and another surface 87, 89 which engages one of the horizontal surfaces 43, 45 on the energizing ring 41. The recesses 67, 69 in the packing elements 55, 57 expand and contact the tubing interior wall to insure proper engagement of the energizing ring 41 and the packing elements 55, 57. In the set condition, shown in FIG. 3, the annular groove 81 in the body 39 is aligned with the annular groove 79 in the mandrel 35, so that the spring 77 is located in both grooves 79, 81, to aid to holding the packoff 11 in the set condition.

When the packoff installation is jarred, the lower packoff 13 is set simultaneously with the upper packoff 11, and in the same manner. Of course, since the lower packoff 13 is oriented in the opposite direction, the various elements of the lower packoff 13 move in the opposite direction of the corresponding elements in the upper packoff 11.

Once the packing installation has been set, the gas lift operation can begin. Gas is pumped down into the well through the annulus 19 between the tubing string 15 and the well casing 17. The gas pressure in the annulus 19, known as the casing pressure, enters the tubing string 15 through the perforation 21. The packoffs 11, 13 seal off the zone of tubing 15 around the perforation 21, so that the casing pressure cannot enter the rest of the tubing 15 until the gas lift valve is opened. When the valve is opened, the gas enters the tubing 15 and aerates the fluid column in the tubing 15, making the fluid column weigh less. When the static head of the fluid column is reduced enough, pressure from the oil reservoir overcomes the resistance of the fluid column, and the oil flows to the surface.

The invention has significant advantages over the prior art. As the packing elements 55, 57 are compressed, the tapered surfaces 47, 49 force the extensions 63, 65 of the packing elements 55, 57 into sealing engagement with the tubing string 15. Any pressure differential which develops across the packing elements 55, 57 will act on the area of the energizing ring 41 and will force the energizing ring 41 into one of the packing elements 55, 57. This action will wedge the packing element 55, 57 more tightly into the tubing string 15. Thus the higher the differential pressure, the tighter the seal across the annular space 19.

While the invention has been shown in only one of its forms, it should be apparent to those skilled in the art that it is not so limited, but is susceptible to various changes and modifications without departing from the spirit thereof.

I claim:

1. A packoff, comprising:

a body;

a packoff mandrel, having one end telescopically received within the body;

an inelastic energizing ring, mounted around the packoff mandrel;

the energizing ring having an inner circumference, an outer circumference, upper and lower horizontal surfaces, and upper and lower tapered surfaces, such that the inner circumference of the energizing ring is wider than the outer circumference of the energizing ring;

a pair of elastomeric packing elements, mounted around the packoff mandrel, one on each side of the energizing ring, each packing element having a matching surface for engagement with one of the horizontal surfaces of the energizing ring and a matching surface for engagement with one of the tapered surfaces of the energizing ring; and means for forcing the packing elements against the energizing ring, so that the tapered surfaces force the packing elements radially outward into sealing engagement with a circumscribing well conduit when the body is moved axially on the packoff mandrel.

2. A packoff, comprising:

a body;

a packoff mandrel, having one end telescopically received within the body;

an inelastic energizing ring, mounted around the packoff mandrel;

the energizing ring having an inner circumference, an outer circumference, upper and lower horizontal surfaces, and upper and lower tapered surfaces, such that the inner circumference of the energizing ring is wider than the outer circumference of the energizing ring;

a pair of elastomeric packing elements, mounted around the packoff mandrel, one on each side of the energizing ring, each packing element having a matching surface for engagement with one of the horizontal surfaces of the energizing ring, a matching surface for engagement with one of the tapered surfaces of the energizing ring, and an annular recess in the inner wall of the packing element; and means for forcing the packing elements against the energizing ring, so that the tapered surfaces force the packing elements radially outward into sealing engagement with a circumscribing well conduit when the body is moved axially on the packoff mandrel.

3. A packoff, comprising:

a body;

a packoff mandrel, having one end telescopically received within the body;

a metal energizing ring, mounted around the packoff mandrel;

the energizing ring having an inner circumference, an outer circumference, upper and lower horizontal surfaces, and upper and lower tapered surfaces, such that the inner circumference of the energizing ring is wider than the outer circumference of the energizing ring;

a seal between the energizing ring and the packoff mandrel;

a pair of elastomeric packing elements, mounted around the packoff mandrel, one on each side of the energizing ring;

each packing element having a matching surface for engagement with one of the horizontal surfaces of the energizing ring, a matching surface for engagement with one of the tapered surfaces of the energizing ring, and an annular recess in the inner wall of the packing element;

means for connecting one of the packing elements to the body, and the other packing element to the packoff mandrel; and means for releasably holding the packoff mandrel against axial movement relative to the body.

* * * * *